United States Patent [19]

Hinzmann

[11] 3,962,957

[45] June 15, 1976

[54] CURLING DEVICE FOR WEBS OF PAPER OR THE LIKE

[75] Inventor: Alfred Hinzmann, Richmond, Va.

[73] Assignee: Hauni-Werke Korber & Co., KG, Hamburg, Germany

[22] Filed: Sept. 10, 1974

[21] Appl. No.: 504,757

[52] U.S. Cl. ..... 93/1 R; 131/17 R; 162/271

[51] Int. Cl.[2] ..... B31F 7/00

[58] Field of Search..... 93/1 R; 162/270, 271, 162/197; 131/17 R, 123, 17 AE; 156/200, 229

[56] References Cited

UNITED STATES PATENTS

| | | | |
|---|---|---|---|
| 2,070,505 | 2/1937 | Beck | 162/271 |
| 2,339,070 | 1/1944 | Hayes | 162/270 X |
| 2,531,619 | 11/1950 | Gonia | 162/270 |
| 3,667,380 | 6/1972 | Schlunke et al. | 162/271 X |

FOREIGN PATENTS OR APPLICATIONS

| | | | |
|---|---|---|---|
| 962,037 | 4/1957 | Germany | 162/270 |

*Primary Examiner*—James F. Coan
*Attorney, Agent, or Firm*—Peter K. Kontler; John Kurucz

[57] ABSTRACT

A curling bar for webs of imitation cork or stiff paper which are used for the making of adhesive-coated uniting bands in filter cigarette making machines has a sharp edge which extends transversely of and flexes the running web to eliminate localized stresses in the material of the web and/or to equalize the length of lengthwise extending portions of the web. The bar is pivotable or otherwise movable in its support (e.g., it can be mounted for pivotal movement about an axis which is normal to the edge) so that the bar can change its angular position in response to unequal distribution of web pressure lengthwise of the edge. Such mounting of the bar reduces the likelihood of breaking the web when the length of the one and/or other marginal portion of the web exceeds the length of the median portion.

10 Claims, 10 Drawing Figures

CURLING DEVICE FOR WEBS OF PAPER OR THE LIKE

BACKGROUND OF THE INVENTION

The present invention relates to apparatus for treating webs consisting of paper, imitation cork or other flexible material, particularly for reducing or completely eliminating localized stresses in and/or for reducing or eliminating differences in the length of lengthwise extending portions of a web which is stored in the form of a bobbin and is used in the manufacture of smokers' products.

It is known to utilize in tobacco processing machines a stationary curling bar which is a device for reducing (and preferably eliminating) localized stresses as well as for reducing or eliminating differences in the length of lengthwise extending strip-shaped portions of a web of paper, imitation cork, reconstituted tobacco or the like. As a rule, the curling bar resembles a blade fixedly mounted in a support and having an elongated edge-like portion which bears against one side of the running web and imparts to the web a tendency to curl. Such treatment of the web by contact with the edge-like portion of the curling bar is intended to eliminate or reduce localized stresses in the material of the web as well as to equalize the length of lengthwise extending portions of the web. The treatment with a curling bar is especially desirable in connection with the making of so-called uniting bands which are used to connect filter rod sections with plain cigarettes, cigarillos or cigars to form filter cigarettes, cigarillos or cigars of unit length or multiple unit length. Uniting bands which are used in a filter cigarette making machine normally consist of artificial cork which is a paper base material powdered on the outside to imitate cork and coated with adhesive at the inside prior to draping it around a filter rod section and around one or more plain cigarettes of unit length. Webs of artificial cork are stored in the form of bobbins which are obtained by subdividing an elongated cylindrical roll of convoluted sheet material into slices of desired axial length. At the present time, sheets of artificial cork have a width of up to and in excess of two yards. Such sheets are convoluted to form long rolls which are thereupon severed in planes at right angles to their axes to yield a plurality of bobbins ready for use in a filter cigarette making machine. In such machine, the web is withdrawn from the bobbin by one or more driven rolls and its leader adheres to the peripheral surface of a suction wheel cooperating with a rotary knife to sever the leader at regular intervals and to thus furnish a succession of uniting bands. During travel from the bobbin to the suction drum, the web is flexed by the curling bar and thereupon passes along a paster which coats one of its sides with a suitable adhesive. The uniting bands are attached to successive groups of filter rod sections and plain cigarettes and are thereupon rolled around such groups to form therewith filter cigarettes of unit length or multiple unit length.

The curling bar performs two important functions namely to eliminate localized stresses in the material of the web and to equalize the length of lengthwise extending portions of the web. Localized stresses develop during the making of sheets which are thereupon coiled and severed to yield discrete bobbins. Such severing also causes changes in the length of lengthwise extending portions of the web. As a rule, at least one marginal portion of the web is longer than the other marginal portion, or both marginal portions are longer than the median portion. In the absence of curling, uniting bands which are obtained by subdividing the web cannot be readily coiled around filter rod sections and plain cigarettes. Also, when coiled, the uniting bands tend to open up so that many filter cigarettes exhibit leaks which are detected by testing apparatus and the respective cigarettes segregated from satisfactory cigarettes.

Conventional curling bars can eliminate some localized stresses and/or differences in the length of lengthwise extending portions of webs. However, their action is not entirely satisfactory and, moreover, they often cause the web to break which invariably entails substantial losses in output. The breakage of webs is attributable to the fact that, when the web travels along the edge portion of a fixedly mounted curling bar, its resistance to tearing is greatly reduced in the region where the one or both marginal portions are longer than the median portion because the pressure which the running web exerts against the curling bar or vice versa must be taken up exclusively by the relatively narrow median portion of the web.

The situation is similar when a running web of relatively stiff paper or the like is converted into the wrapper of a continuous filter rod or when a web of reconstituted tobacco or the like is converted into helical wrappers of cigars.

SUMMARY OF THE INVENTION

An object of the invention is to provide a novel and improved apparatus for reducing or completely eliminating localized stresses (if any) in a running web of relatively stiff paper, imitation cork, reconstituted tobacco, tobacco leaf or other flexible material, and for simultaneously eliminating differences (if any) in the length of lengthwise extending portions or strips of the web.

Another object of the invention is to provide an apparatus of the just outlined character which is less likely to cause breakage of the web than heretofore known apparatus.

A further object of the invention is to provide a novel and improved curling device for use in the above outlined apparatus.

An additional object of the invention is to provide a novel and improved support for the curling device.

Still another object of the invention is to provide an improved curling bar which can be used in existing machines for the production of smokers' products.

A further object of the invention is to provide a curling bar which can properly condition relatively stiff webs to render such webs suffficiently pliable for the conversion into wrappers which connect rod-shaped portions of smokers' products, which constitute wrappers around fillers of fibrous or other filter material for tobacco smoke, or which constitute inner or outer wrappers for cigars or cigarillos.

The invention is embodied in an apparatus for reducing localized stresses (if any) in and/or for reducing differences (if any) in the length of lengthwise extending portions of a web of paper or other flexible material, particularly a web which is stored in the form of a bobbin and is used in the manufacture of smokers' products including cigarettes, cigarillos, cigars and/or filter rod sections. The apparatus comprises means for moving a web lengthwise along a predetermined path, a supporting device which is adjacent to the path for the web, and a curling device which is mounted in the supporting device and has an elongated member (e.g., a wedge-like portion formed with a rather pronounced edge) extending substantially transversely of and into the path so that one side of the web exerts pressure against the elongated member and the latter flexes the web. In accordance with a feature of the invention, at least the elongated member of the curling device is movable with respect to the supporting device in response to unequal distribution of web pressure lengthwise of the member to thereby promote the equalization of web pressure, as considered transversely of the path. For example, the entire curling device may be mounted in the support for tilting movement about the axis of a pivot which is substantially normal to the elongated member, i.e., which extends in the longitudinal direction of the web. The axis of the pivot is preferably located substantially or exactly midway between the marginal portions of the web in the aforementioned path. The apparatus preferably further comprises means for limiting the extent of movement of the elongated member with respect to the supporting device.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
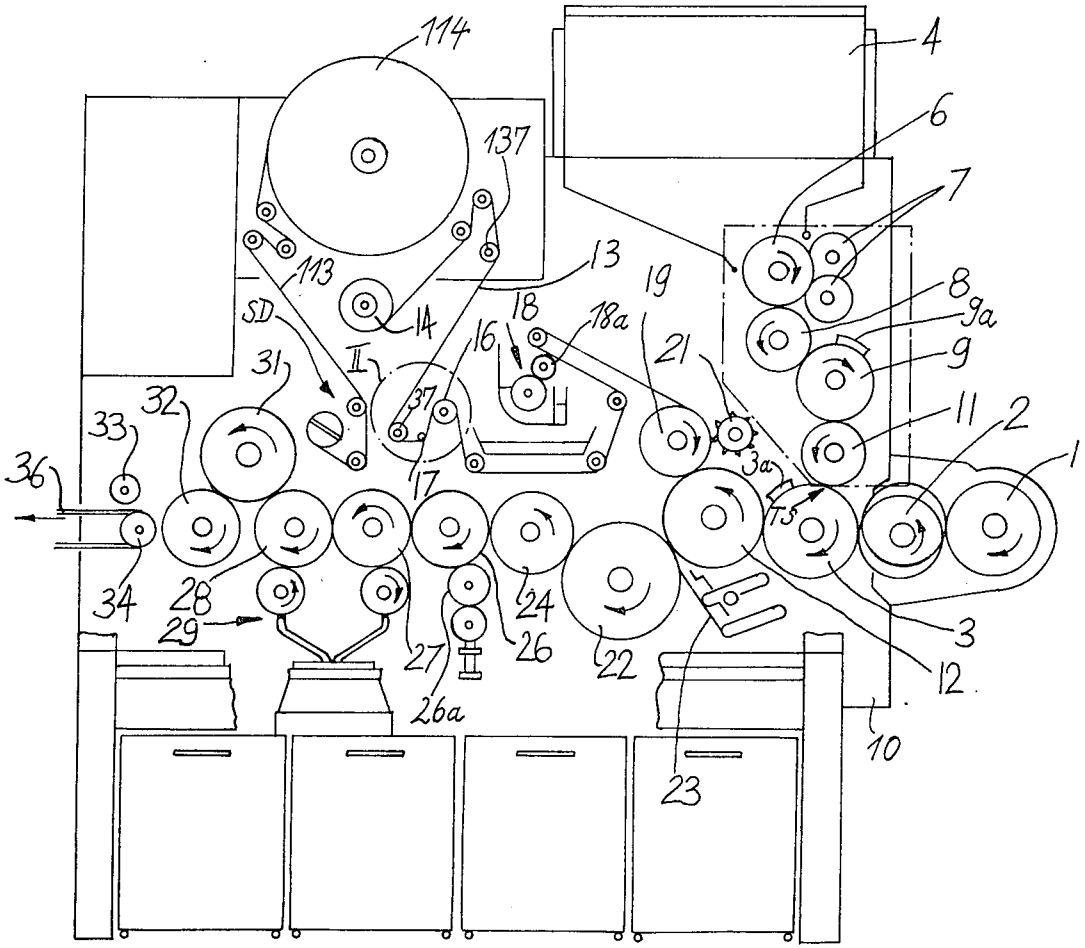
FIG. 1 is a schematic side elevational view of a filter cigarette making machine including a web treating apparatus which embodies the invention.

FIG. 1 shows a filter cigarette making machine of the type known as MAX-S produced by Hauni-Werke, Körber & Co. K. G., of Hamburg-Bergedorf, Western Germany. The machine is directly coupled to a cigarette rod making machine which feeds a succession of plain cigarettes of unit length to a rotary drum-shaped row forming conveyor 1 mounted in the frame 10 of the filter cigarette machine. The conveyor 1 has flutes which are machined into its peripheral surface and extend with parallelism with its axis. The cigarette rod making machine feeds plain cigarettes of unit length into successive flutes of the conveyor 1 but the cigarettes in the first, third, etc. flutes are staggered with respect to the cigarettes in the second, fourth, etc. flutes so that the cigarettes form two rows which are respectively transferred into the flutes of two discrete rotary drum-shaped aligning conveyors 2 in the frame 10. The aligning conveyors 2 rotate at different speeds and/or transport the cigarettes through different distances so that each plain cigarette of one row is aligned with a plain cigarette of the other row when such cigarettes are transferred into successive flutes of a rotary drum-shaped assembly conveyor 3 of the filter cigarette making machine. Immediately after transfer from the aligning conveyors 2, the pairs of cigarettes in the flutes of the assembly conveyor 3 are spaced apart so that the width of gaps between such pairs of cigarettes at least equals but preferably exceeds the length of a filter rod section of double unit length.

The frame 10 of the filter cigarette making machine supports a magazine or hopper 4 for a supply of parallel filter rod sections of six times unit length. The open lower end of the magazine 4 is located above a portion of a rotary drum-shaped severing conveyor 6 having flutes which receive discrete filter rod sections and transport them past two rapidly rotating disk-shaped knives 7 which convert each section of six times unit length into a group of three coaxial filter rod sections of double unit length. Each filter rod section of a group is accepted by one of three rotary drum-shaped staggering conveyors 8 (only one shown) which transport the respective sections of double unit length through different distances and/or at different speeds so as to convert each group into an array of three filter rod sections which are located one behind the other, as considered in the circumferential direction of the illustrated drum 8. The thus staggered sections of double unit length are introduced into successive flutes of a rotary drum-shaped shuffling conveyor 9 which cooperates with stationary cams **9*a* to shift at least two filter rod sections of a group axially so as to convert the filter rod sections into a single row wherein each preceding section is in exact register with the next-following section. The shuffling conveyor 9 delivers successive filter rod sections of double unit length into the flutes of a rotary drum-shaped accelerating conveyor 11 which inserts a filter rod section into each flute of the assembly conveyor (at a transfer station TS) so that the section enters the gap between the respective pair of plain cigarettes of unit length. The thus obtained groups of rod-shaped articles (each such group contains two plain cigarettes of unit length and a filter rod section of double unit length therebetween) are caused to move between two stationary cams 3*a* which cause one or both plain cigarettes of a group to move axially toward the respective filter rod section so that the inner end faces of both cigarettes abut against the respective end faces of the associated filter rod section. The thus shortened groups are thereupon transferred into successive flutes of a rotary drum-shaped transfer conveyor 12.**

The frame 10 further supports a bobbin 14 for a running web 13 of stiff paper, imitation cork or other suitable wrapping material. The web 13 is drawn off the bobbin 14 by an advancing roll 16 which cooperates with two idler rolls 38, 39 (see FIG. 2) and causes the web to move past a novel curling device 17 and on toward a rotary applicator **18*a* forming part of a paster 18. The applicator 18*a* coats one side of the web 13 with a suitable adhesive, and the leader of the web 13 is attracted to the peripheral surface of a rotary suction drum 19 which cooperates with a rotary knife 21 so as to sever the leader of the web 13 at regular intervals whereby the web yields a succession of adhesive-coated uniting bands. The leader of a fresh web 113 which is stored on a fresh bobbin 114 is held in a position of readiness in a splicing device SD which is actuated shortly prior to expiration of the supply of web 13 on the bobbin 14 so as to attach the leader of the fresh web 113 to the adjacent portion of the running web 13 and to sever the web 13 from the material on the bobbin 14 immediately behind the thus obtained splice. Reference may be had to the commonly owned U.S. Pat. No. 3,749,634 granted July 31, 1973 to Krause which discloses a splicing device capable of being used in the filter cigarette making machine of FIG. 1**.

The suction drum 19 applies successive uniting bands to successive groups of rod-shaped articles in the flutes of the transfer conveyor 12 in such a way that each uniting band contacts the respective filter rod section of double unit length and the adjacent inner end portions of the corresponding plain cigarettes of unit length. Such groups (each of which carries a uniting band) are thereupon transferred onto a rotary drum-shaped wrapping conveyor 22 which cooperates with a rolling device 23 (e.g., a device of the type disclosed in the commonly owned U.S. Pat. No. 3,483,873 or 3,527,234 to Hinzmann) to convolute the uniting bands around the respective filter rod sections and the adjacent end portions of plain cigarettes and to thus convert each group into a filter cigarette of double unit length. The cigarettes of double unit length are transferred into successive flutes of a rotary drum-shaped drying conveyor 24 which transfers the cigarettes into successive flutes of a rotary drum-shaped severing conveyor 26 cooperating with a rotary disk-shaped knife 26*a* to sever each filter cigarette of double unit length midway between its ends and to thus convert such cigarettes into pairs of coaxial filter cigarettes of unit length. The knife 26*a* severs each filter cigarette of double unit length midway across the convoluted uniting band so that each filter cigarette of unit length contains a plain cigarette, a filter rod section of unit length and a convoluted uniting band which completely surrounds the filter rod section of unit length and the adjacent end portion of the plain cigarette. The severing conveyor 26 may be associated with or forms part of an ejecting device for defective filter cigarettes of double unit length or unit length. For example, such ejecting device may be designed to automatically segregate those filter cigarettes which are produced during starting of the filter cigarette making machine and which are bound or likely to be defective.

The severing conveyor 26 delivers pairs of coaxial filter cigarettes of unit length to a first rotary drum-shaped conveyor 27 of an inverting or turn-around device 29 which is preferably constructed and assembled in a manner as disclosed in the commonly owned U.S. Pat. No. 3,583,546 granted June 8, 1971 to G. Koop. The inverting device 29 includes a further rotary drum shaped conveyor 28 whose flutes carry a single row of filter cigarettes of unit length (the filter rod sections of all cigarettes forming this single row face in the same direction) and deliver such cigarettes to successive flutes of a rotary drum-shaped testing conveyor 31 forming part of a device for monitoring the condition of wrappers of filter cigarettes of unit length and for producing signals which are used for segregation of cigarettes with defective wrappers. The defects may be due to opening of seams of the wrappers for the fillers of plain cigarettes, to opening of seams on the wrappers of the filter rod sections, or improper winding of adhesive-coated uniting bands on the wrapping conveyor 22. The ejection of cigarettes with defective wrappers can take place during transport in the flutes of a rotary drum-shaped transfer conveyor 32 which follows the testing conveyor 31 and may form part of a second monitoring device which detects the mass or quantity of tobacco particles in the tobacco-containing end portions of filter cigarettes of unit length (i.e., in those end portions which are remote from the respective filter rod sections of unit length). The conveyor 32 delivers satisfactory filter cigarettes of unit length onto the upper stretch of an endless belt conveyor 36 whereon the cigarettes are braked by a roll 33 and which serves to transport cigarettes to a tray filling station, to a pneumatic conveyor, to storage, or directly into a packing machine, not shown. The reference character 34 denotes a roll which cooperates with the braking roll 33 and may constitute a pulley for the illustrated end turn of the belt conveyor 36.

Figure 2:
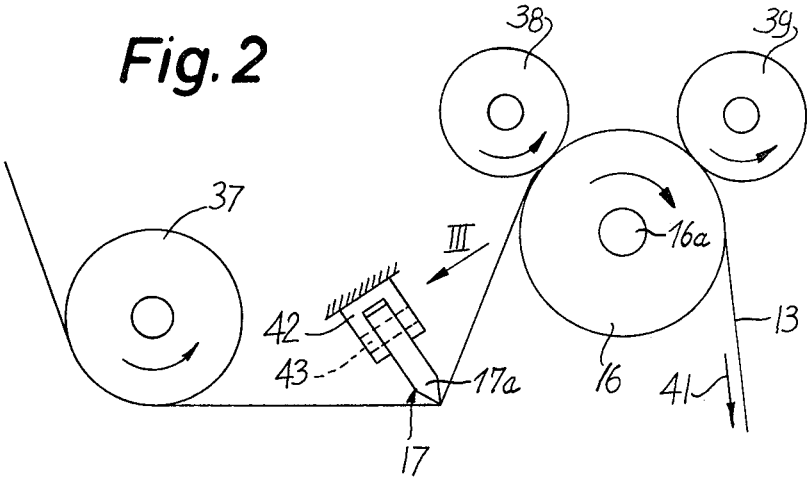
FIG. 2 is an enlarged side elevational view of the web treating apparatus.

FIG. 2 shows that the curling device 17 extends into the path for the web 13 between a guide roll 37 and the advancing roll 16. The idler rolls 38, 39 are biased against the advancing roll 16 so that the latter can transport the web 13 without slippage when its shaft 16*a* receives torque from the prime mover of the filter cigarette making machine. The elongated wedge like edge portion or web contacting member 17*a* of the curling device 17 extends transversely of the path for the web 13 and bears against that side of the web which is to be coated with adhesive during travel past the applicator 18*a* of the paster 18. The direction of lengthwise movement of the web 13 is indicated in FIG. 2 by an arrow 41.

Figure 3:
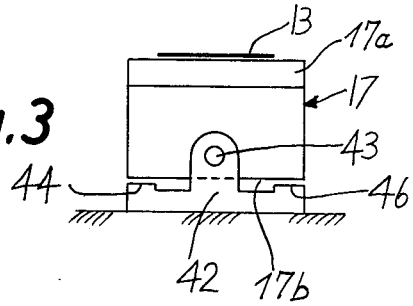
FIG. 3 is a view as seen in the direction of arrow III in FIG. 2, showing in detail the curling device and the supporting device of the web treating apparatus.

FIG. 3 shows that the curling device 17 is tiltable on a pivot 43 which is mounted in and extends between the spaced-apart arms of a bifurcated supporting device 42 secured to the frame 10 of the filter cigarette making machine. The pivot 43 extends in parallelism with the longitudinal direction of the web 13 (i.e., at right angles to the edge portion or web contacting member 17*a*) and is located midway between the ends of the curling device 17, i.e., midway between the marginal portions of the web 13. The rear end face 17*b* of the curling device 17 can abut against one or the other of two stops 44, 46 which are provided therefor on the supporting device 42 and serve to limit the extent to which the member 17*a* can be tilted on the pivot 43. The stops 44, 46 further insure that the curling device 17 cannot interfere with rapid and convenient threading of the leader of a fresh web (113 in FIG. 1) through the filter cigarette making machine. However, the clearance between the rear edge face 17*b* and the stop 44 and/or 46 is sufficient to enable the member 17*a* to turn about the axis of the pivot 43 to the extent which is necessary to insure a uniform distribution (or the absence) of internal stresses in those increments of the web 13 which advance beyond the curling station. The turning of curling device 17 about the axis of the pivot 43 takes place in response to unequal distribution of web pressure lengthwise of the member 17*a*, and such turning promotes the equalization of web pressure. The device 17 is pivotable in a plane which is normal to the path for the web 13.

An important advantage of the movably mounted curling device 17 is that its member 17*a* reduces or eliminates localized stresses in the material of the web and that the member 17*a* also performs all such functions which are expected from a fixedly mounted curling bar, i.e., to compensate for eventual differences between the length of the two marginal portions of a certain stretch of or the entire web 13. Moreover, the movable curling device 17 is less likely to tear the web 13 in the event that one marginal portion of the web is longer than the other because the member 17*a* can turn on or with the pivot 43 when necessary so that each strip-shaped (lengthwise extending) portion of the traveling web 13 can bear against the member 17*a* with the same force.

The reasons for uneven pressure with which the web bears the edge portion of a fixedly mounted curling bar are numerous and are attributable in part to the method of making the bobbins, in part to the nature of treatment to which the web is subjected prior to reaching the curling station, in part to stiffness of the material of the web, in part to uneven wear upon the edge portion, and in part to differences in moisture content of various portions of the web (for example, when the bobbins are improperly stored in a tobacco processing plant). For example, if the axis about which the guide roll 37 rotates is not exactly parallel to the axis of the preceding guide roll 137 (FIG. 1) or to the axis of the advancing roll 16, one marginal portion of the web 13 is likely to be lengthened and such lengthened marginal portion exerts a lesser pressure against the respective portion of a fixedly mounted curling bar. Furthermore, the outer side of the web 13 (i.e., that side which is not coated with adhesive during travel past the applicator 18*a*) is normally treated with a waterproofing substance which causes the web to curl transversely, i.e., to lengthen its marginal portions with respect to the median portion. The application of adhesive by the member 18*a* results in a tendency of the web to curl lengthwise, i.e., its adhesive-coated side tends to assume a convex shape. This tendency can be counteracted only if the length of each portion of the running web (as considered transversely of the direction of its movement) is properly equalized by the curling device and such equalization is possible only if at least the web contacting member of the curling device is tiltable or otherwise movable so as to enable the full width of the web to bear against the web contacting member with uniform pressure.

One of the main reasons for differences in the length of marginal portions of a web consisting of imitation cork or other paper-like substance is that the bobbins 14, 114 are obtained by severing a relatively long cylindrical roll (which may have an axial length in the range of two yards or more) into discrete bobbins having an axial length in the range of 2 inches or less. Such severing of the long roll invariably results in lengthening of one or both marginal portions of webs on the thus obtained bobbins so that, in the absence of any movability of the curling device, the median portion (and eventually one of the two marginal portions) of the web is subjected to a very pronounced tensional stress during travel past the curling station. This results in aforementioned tearing of the web and in unsatisfactory equalization of the length of neighboring portions of the web (as considered in a direction from the one toward the other marginal portion). If the curling action is unsatisfactory, the uniting bands which are convoluted around the groups of rod-shaped articles on the wrapping conveyor 22 of FIG. 1 are likely to exhibit leaks, especially at their ends where the tendency of the material to flex away from the adjacent portion of the plain cigarette or filter rod section is very pronounced. The leaks are detected by the aforediscussed testing device and result in segregation of the respective cigarettes from satisfactory articles.

Figure 4:
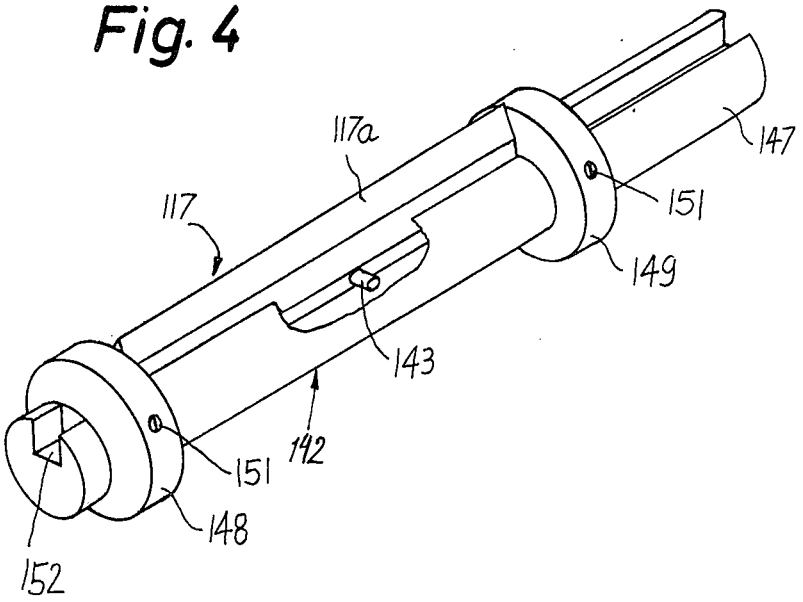
FIG. 4 is a perspective view of a modified supporting device for the curling device.

FIG. 4 shows a modified supporting device 142 having a cylindrical rod 147 and two spaced-apart sleeves 148, 149 secured to the rod 147 by screws 151 or other suitable fasteners. The rod 147 is formed with a longitudinally extending groove 152 for a tiltable blade-like curling device 117 having an elongated edge portion or web contacting member 117*a*. A pivot 143 which extends through registering holes in the rod 147 and the rear portion of the curling device 117 enables the latter to turn in the groove 152 between the sleeves 148, 149. The bottom surface of the groove 152 serves as a stop which limits the extent of pivotal movement of the member 117*a* when the latter is engaged by a running web, not shown. That end portion of the rod 147 which extends outwardly beyond the sleeve 149 can be inserted into and secured in a hole or socket of the frame 10. The groove 152 confines the device 117 to movement in a plane which is normal to the axis of the pivot 153 and to the path for the running web.

Figure 5:
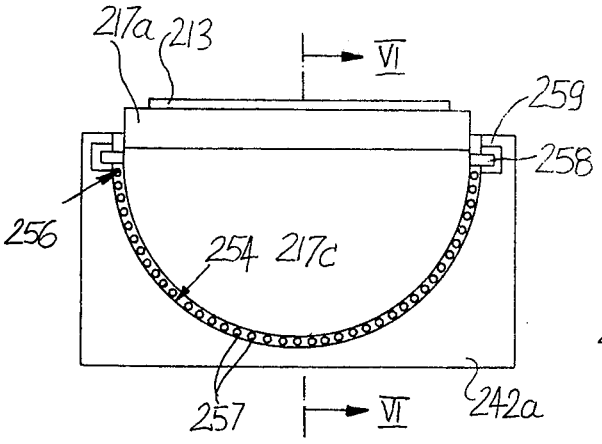
FIG. 5 is a longitudinal sectional view of a further supporting device and a side elevational view of the associated curling device.
Figure 6:
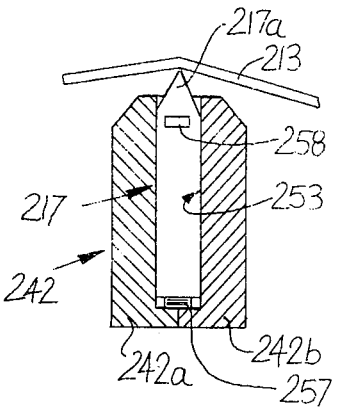
FIG. 6 is a sectional view as seen in the direction of arrows from the line VI—VI of FIG. 5, with the curling device shown in an end elevational view.

FIGS. 5 and 6 show a supporting device 242 having two mirror symmetrical halves 242*a*, 242*b* which are connected to each other by screws or the like. The assembled sections 242*a*, 242*b* define a socket 253 bounded by a concave surface 254. The curling device 217 has an elongated web contacting member 217*a* and a projection or rear portion 217*c* bounded by a convex surface 256 which is adjacent to the concave surface 254. Rolling elements 257 between the surfaces 254, 256 reduce friction when the member 217*a* is tilted by the running web 213. The ends of the curling device 217 have lugs 258 which extend with some clearance into adjacent recesses 259 of the supporting device 242 whereby the surfaces bounding the recesses 259 limit the extent of movement of the curling device 217. The socket 253 confines the device 217 to movements in a plane which is normal to the path for the web 213. The supporting device 242 is removably mounted in the frame (not shown) of the filter cigarette making machine.

Figure 7:
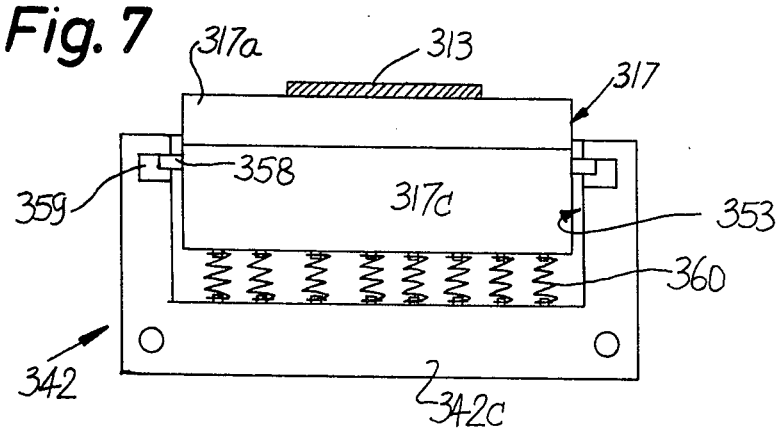
FIG. 7 is a longitudinal sectional view of still another supporting device and a side elevational view of the associated curling device.

The supporting device 342 of FIG. 7 has a socket 353 for the main portion 317*c* of a blade-like curling device 317 having an elongated web contacting member 317*a*. The base 342*c* of the device 342 constitutes a retainer or back support for prestressed helical springs 360 which react against the supporting device 342 and bear against the underside of the main portion 317*c*. The lugs 358 and recesses 359 are functional equivalents of the lugs and recesses shown in FIGS. 5 and 6. The supporting device 342 can be assembled of two mirror symmetrical halves or three or more sections.

When the pressure of web 313 lengthwise of the member 317*a* is not uniform, one or more springs 360 yield or expand so that the inclination of the curling device 317 with respect to the supporting device 342 changes. The device 317 can pivot about an axis which is located midway between the lugs 358 or closer to the one or the other lug. If desired, the main portions 317*c* can be affixed to the supporting device 342; the member 317*a* is then movable relative to 317*c* and the springs 360 or analogous biasing means are installed between 317*a* and 317*c*.

The main portion 317*c* and the retainer 342*c* may be provided with guide pins which are surrounded by the adjacent end convolutions of the springs 360.

The curling device preferably consists of steel or another suitable metallic material. However, certain types of synthetic plastic materials can be used instead of or as coatings for metallic curling devices.

As mentioned above, the improved curling device can be used with equal advantage in other types of tobacco processing machines and/or elsewhere. For example, the curling device can form part of an apparatus for treating webs which are to be converted into wrappers of simple or composite filter rod sections or for treating webs which are to be wound onto cigar or cigarillo fillers. Moreover, the curling device can be used to flex at least certain types of material which is to form wrappers of cigarettes.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. Apparatus for reducing localized stresses in and/or for equalizing the length of lengthwise extending portions of a web consisting of paper of other flexible material, particularly of a web which is stored in the form of a bobbin and is used in the manufacture of smokers' products, comprising means for moving a web lengthwise along a predetermined path; a supporting device adjacent to said path; and a curling device mounted in said supporting device and having an elongated web contacting member extending substantially transversely of and into said path so that one side of the web in said path exerts pressure against and the web is flexed by said member, at least said member of said curling device being tiltable (movable) with respect to said supporting device in a plane extending transversely of said path in response to unequal distribution of web pressure lengthwise of said member to thereby promote the equalization of web pressure lengthwise of said member.

2. Apparatus as defined in claim 1, wherein said member has a longitudinally extending edge which is engaged by the web in said path.

3. Apparatus as defined in claim 1, wherein said moving means comprises a rotary guide element upstream and a rotary advancing element downstream of said curling device.

4. Apparatus as defined in claim 1, further comprising means for limiting the extent of movement of said member with respect to said supporting device.

5. Apparatus as defined in claim 1, wherein the length of said member exceeds the width of the web in said path and said member is movable in a plane which is substantially normal to said path.

6. Apparatus as defined in claim 1, wherein said supporting device comprises a retainer and resilient means interposed between said retainer and said curling device whereby said resilient means yields in response to movement of said member with respect to said supporting device.

7. Apparatus as defined in claim 1, further comprising means for applying adhesive to one side of the web in said path downstream of said curling device and means for severing the web at predetermined intervals downstream of said adhesive applying means.

8. Apparatus for reducing localized stresses in and/or for equalizing the length of lengthwise extending portions of a web consisting of paper or other flexible material, particularly of a web which is stored in the form of a bobbin and is used in the manufacture of smokers' products, comprising means for moving a web lengthwise along a predetermined path; a supporting device adjacent to said path; and a curling device mounted in said supporting device and having an elongated web contacting member extending substantially transversely of and into said path so that one side of the web in said path exerts pressure against and the web is flexed by said member, said supporting device comprising a pivot which is substantially normal to said member and said curling device being turnable about the axis of said pivot so that said member of said curling device pivots with respect to said supporting device in response to unequal distribution of web pressure lengthwise of said member to thereby promote the equalization of web pressure lengthwise of said member.

9. Apparatus as defined in claim 8, wherein the axis of said pivot is located substantially midway between the marginal portions of the web in said path.

10. Apparatus for reducing localized stresses in and/or for equalizing the length of lengthwise extending portions of a web consisting of paper or other flexible material, particularly of a web which is stored in the form of a bobbin and is used in the manufacture of smokers' products, comprising means for moving a web lengthwise along a predetermined path; a supporting device adjacent to said path; and a curling device mounted in said supporting device and having an elongated web contacting member extending substantially transversely of and into said path so that one side of the web in said path exerts pressure against and the web is flexed by said member, one of said devices having a socket bounded by a concave surface and the other of said devices having a projection extending into said socket and having a convex surface adjacent to said concave surface, said curling device being movable with respect ot said supporting device in response to unequal distribution of web pressure lengthwise of said member to thereby promote the equalization of web pressure lengthwise of said member, one of said surfaces moving relative to the other of said surfaces in response to movement of said curling device with respect to said supporting device.

* * * * *